US010032574B2

(12) United States Patent
Chen

(10) Patent No.: US 10,032,574 B2
(45) Date of Patent: Jul. 24, 2018

(54) MEMBRANE KEYSWITCH WITH A SPACER ISOLATED TRIGGER ZONE

(71) Applicant: Chicony Electronics Co., Ltd., New Taipei (TW)

(72) Inventor: Chia-Hsin Chen, Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 15/259,053

(22) Filed: Sep. 8, 2016

(65) Prior Publication Data

US 2018/0005779 A1 Jan. 4, 2018

(30) Foreign Application Priority Data

Jul. 1, 2016 (TW) ..... 105209984 U

(51) Int. Cl.
*H01H 13/703* (2006.01)
*H01H 13/10* (2006.01)
*H01H 3/12* (2006.01)

(52) U.S. Cl.
CPC ..... *H01H 13/703* (2013.01); *H01H 3/125* (2013.01); *H01H 13/10* (2013.01); *H01H 2211/006* (2013.01)

(58) Field of Classification Search
CPC .... H01H 13/70; H01H 13/704; H01H 13/807; H01H 2215/00; H01H 2215/006; H01H 13/703
USPC ..... 200/5 A, 512
See application file for complete search history.

(56) References Cited

U.S. PATENT DOCUMENTS 5,561,278 A * 10/1996 Rutten ..... H01H 13/702 200/5 A
9,870,880 B2 * 1/2018 Zercoe ..... H01H 13/06

FOREIGN PATENT DOCUMENTS

TW M291046 5/2006

* cited by examiner

*Primary Examiner* — Vanessa Girardi
(74) *Attorney, Agent, or Firm* — CKC & Partners Co., Ltd.

(57) ABSTRACT

A keyswitch device includes a bottom plate, a membrane circuit board, a keyswitch assembly, and at least one spacer structure. The membrane circuit board is located over the bottom plate and has a trigger zone. The membrane circuit board is configured to generate a trigger signal when the trigger zone is pressed. The keyswitch assembly is disposed over the membrane circuit board and configured to press the trigger zone. The spacer structure is disposed between the bottom plate and the membrane circuit board and substantially aligned with the peripheral edge of the trigger zone. The spacer structure is configured to separate the bottom plate and the membrane circuit board by a distance.

12 Claims, 5 Drawing Sheets

MEMBRANE KEYSWITCH WITH A SPACER ISOLATED TRIGGER ZONE

RELATED APPLICATIONS

This application claims priority to Taiwan Application Serial Number 105209984, filed Jul. 1, 2016, which is herein incorporated by reference.

BACKGROUND

Technical Field

The present disclosure relates to a keyswitch device and a keyboard.

Description of Related Art

Currently, the keyboard is one of the indispensable input devices to enter text or numbers while using a PC. Moreover, consumer electronic products used in daily life or large-scale processing equipment used in the industrial sector all require key structure units input devices to operate.

Keyswitch devices commonly can be classified into membrane keyswitches and mechanical keyswitches according to different triggering ways. While pressing a membrane keyswitch, the rubber dome under the keycap will be deformed, so as to make the conductive pillar in the rubber dome contact the membrane circuit board. Therefore, the metal contacts on the upper membrane layer and the lower membrane layer contact each other to generate signals. That is, whether the circuits of the membrane keyswitch are turned on or off depends on whether the metal contacts (or positive and negative elastic contact pieces) contact each other.

Regarding the conventional membrane keyswitch, the membrane circuit board therein is usually disposed on the bottom plate. However, when a foreign object inadvertently enters the space formed between the membrane circuit board and the bottom plate, the foreign object may deform the lower membrane layer toward the upper membrane layer. If the foreign object is right under the metal contact of the lower membrane layer, the foreign object may cause the problem of false triggering (i.e., the metal contacts of the upper and lower membrane layers contact each other while the keycap is not pressed).

Accordingly, how to provide a keyswitch device and a keyboard to solve the aforementioned problems becomes an important issue to be solved by those in the industry.

SUMMARY

Accordingly, an aspect of the disclosure is to provide a keyswitch device and a keyboard that can effectively reduce the overall number of components.

According to an embodiment of the disclosure, the keyswitch device includes a bottom plate, a membrane circuit board, a keyswitch assembly, and at least one spacer structure. The membrane circuit board is located over the bottom plate and has a trigger zone. The membrane circuit board is configured to generate a trigger signal when the trigger zone is pressed. The keyswitch assembly is disposed over the membrane circuit board and configured to press the trigger zone. The spacer structure is disposed between the bottom plate and the membrane circuit board and substantially aligned with a peripheral edge of the trigger zone. The spacer structure is configured to separate the bottom plate and the membrane circuit board by a distance.

In an embodiment of the disclosure, the membrane circuit board includes a lower membrane layer, an upper membrane layer, and a spacer layer. The lower membrane layer faces the bottom plate. A lower conductive point is disposed on the lower membrane layer. The upper membrane layer faces the keyswitch assembly. An upper conductive point is disposed on the upper membrane layer. The spacer layer is disposed between the lower membrane layer and the upper membrane layer and has a through hole. The upper conductive point is configured to contact the lower conductive point via the through hole, so as to make the lower conductive point generate the trigger signal correspondingly. The trigger zone is substantially defined by a zone orthogonally projected from the through hole to the lower membrane layer and to the upper membrane layer.

In an embodiment of the disclosure, the spacer structure is ring-shaped and surrounds a peripheral edge of the trigger zone.

In an embodiment of the disclosure, the keyswitch device further includes a plurality of the spacer structures. The spacer structures are arranged to surround a peripheral edge of the trigger zone.

In an embodiment of the disclosure, the spacer structure is directly fixed to a surface of the membrane circuit board facing the bottom plate.

In an embodiment of the disclosure, the spacer structure is directly fixed to a surface of the bottom plate facing the membrane circuit board.

In an embodiment of the disclosure, the spacer structure is a cured UV glue layer, an adhesive layer, or a printing ink layer.

In an embodiment of the disclosure, a thickness of he spacer structure is in a range from about 0.05 cm to 0.06 cm.

According to another embodiment of the disclosure, the keyboard includes a bottom plate, a membrane circuit board, a plurality of keyswitch assemblies, and a plurality of spacer structures. The membrane circuit board is located over the bottom plate and has a plurality of trigger zones. The membrane circuit board is configured to generate a trigger signal when any of the trigger zones is pressed. The keyswitch assemblies are disposed over the membrane circuit board. Each of the keyswitch assemblies is configured to press a corresponding one of the trigger zones. The spacer structures are disposed between the bottom plate and the membrane circuit board. Each of the spacer structures is substantially aligned with a peripheral edge of a corresponding one of the trigger zones and configured to separate the bottom plate and the membrane circuit board by a distance.

In an embodiment of the disclosure, the membrane circuit board includes a lower membrane layer, an upper membrane layer, and a spacer layer. The lower membrane layer faces the bottom plate. A plurality of lower conductive points are disposed on the lower membrane layer. The upper membrane layer faces the keyswitch assemblies. A plurality of upper conductive points are disposed on the upper membrane layer and respectively corresponding to the lower conductive points. The spacer layer is disposed between the lower membrane layer and the upper membrane layer and has a plurality of through holes. Each of the upper conductive points is configured to contact a corresponding one of the lower conductive points via a corresponding one of the through holes, so as to make the corresponding lower conductive point generate the trigger signal correspondingly. The trigger zones are substantially defined by zones orthogonally projected from the through holes to the lower membrane layer and to the upper membrane layer.

Accordingly, in the keyswitch device and the keyboard of the present disclosure, the spacer structure is disposed between the bottom plate and the membrane circuit board, so as to separate the bottom plate and the membrane circuit board by a distance. Therefore, even if a foreign object inadvertently enters the space formed between the membrane circuit board and the bottom plate, the foreign object will not abut against and deform the lower membrane layer toward the upper membrane layer, so as to effectively prevent from the problem of false triggering.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
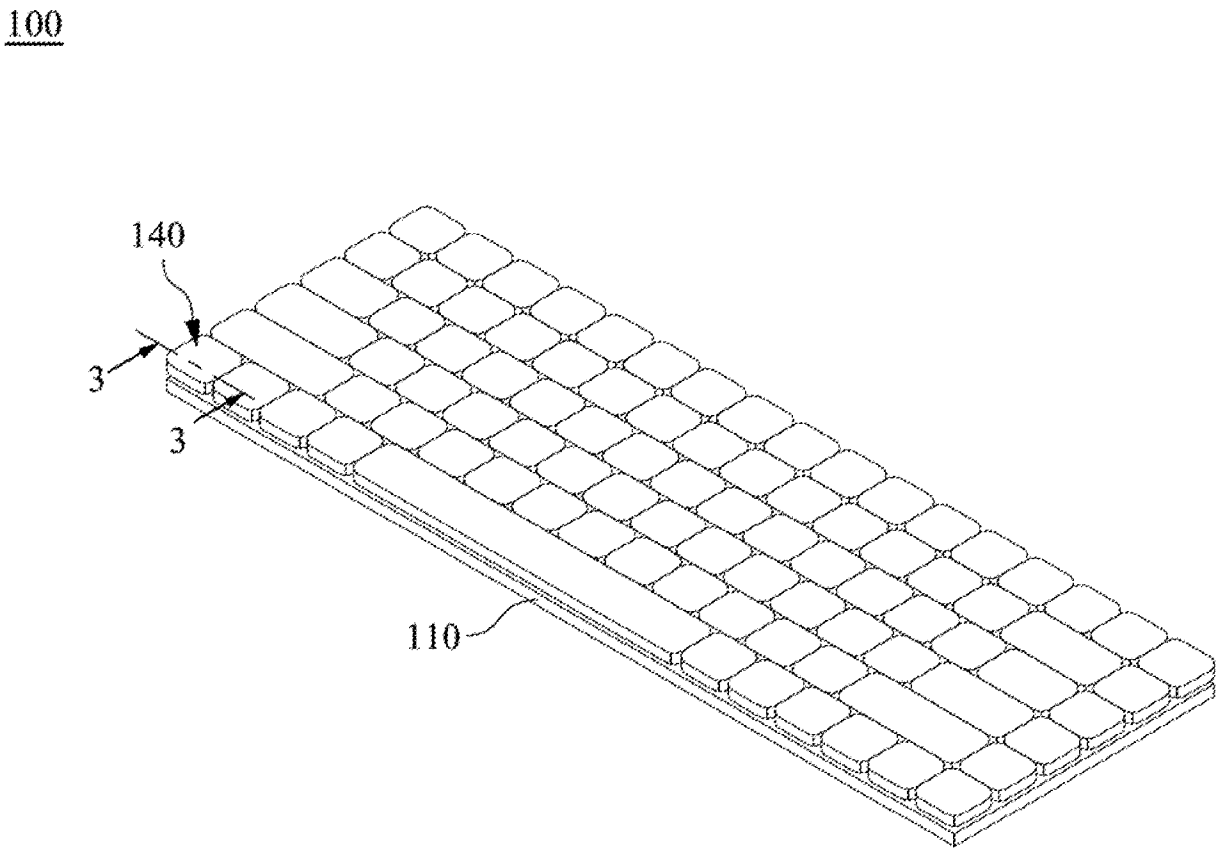
FIG. 1 is a perspective view of a keyboard according to an embodiment of the disclosure.

Reference will now be made in detail to the present embodiments of the disclosure, examples of which are illustrated in the accompanying drawings. Wherever possible, the same reference numbers are used in the drawings and the description to refer to the same or like parts.

Reference is made to FIG. 1. FIG. 1 is a perspective view of a keyboard 100 according to an embodiment of the disclosure. As shown in FIG. 1, the keyboard 100 of the disclosure can be an external keyboard (e.g., a keyboard with a PS/2 interface or a keyboard with a USB interface) used in a desktop computer, or can be a part of a computer system having an input device that is in the form of a keyboard (e.g., a notebook computer or a laptop computer), but the disclosure is not limited in this regard. That is, the keyboard 100 of the disclosure can be used in any electronic product that adopts keyswitch devices to be the input interface.

Figure 2:
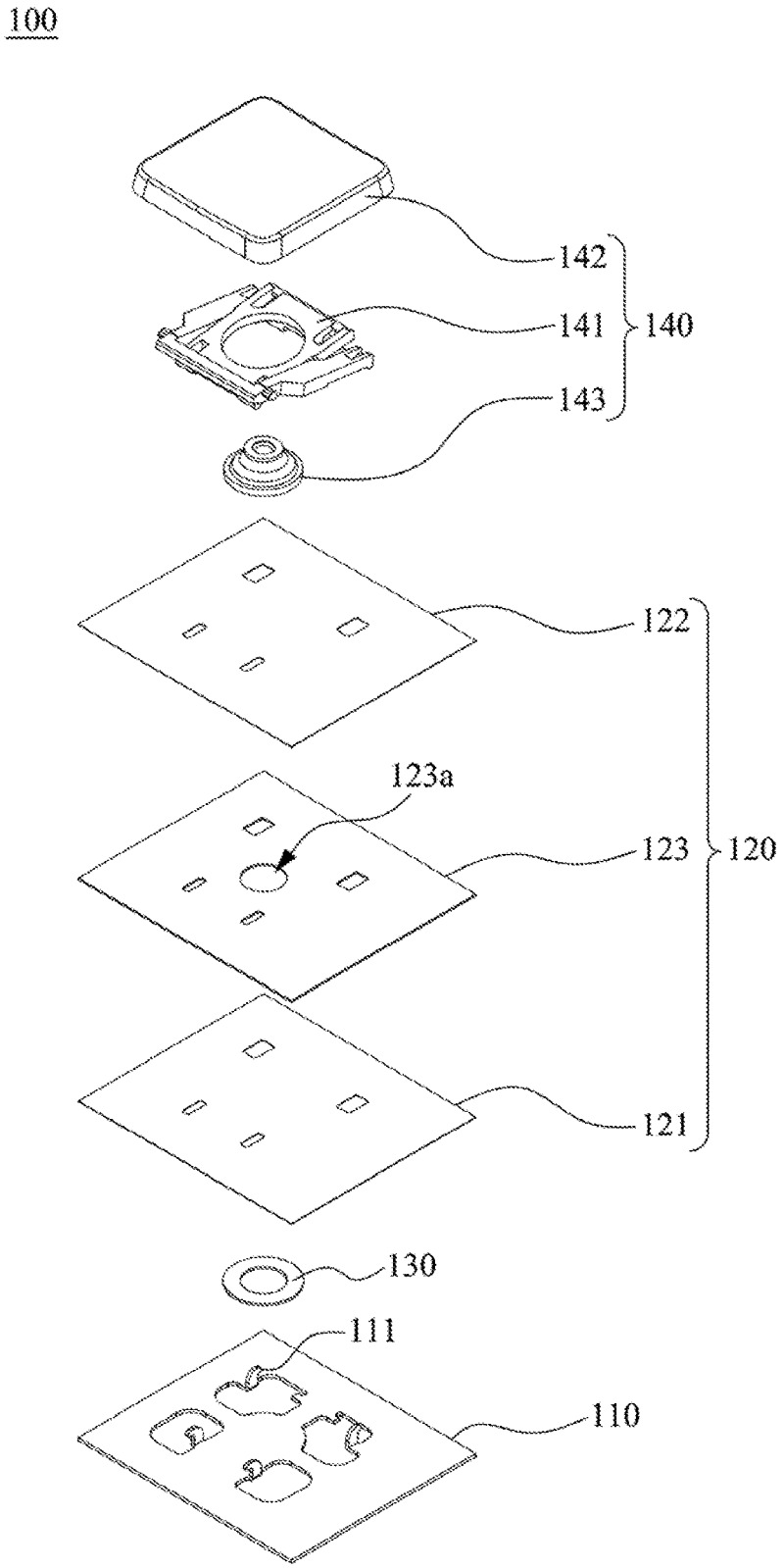
FIG. 2 is a partial exploded view of the keyboard in FIG. 1.
Figure 3:
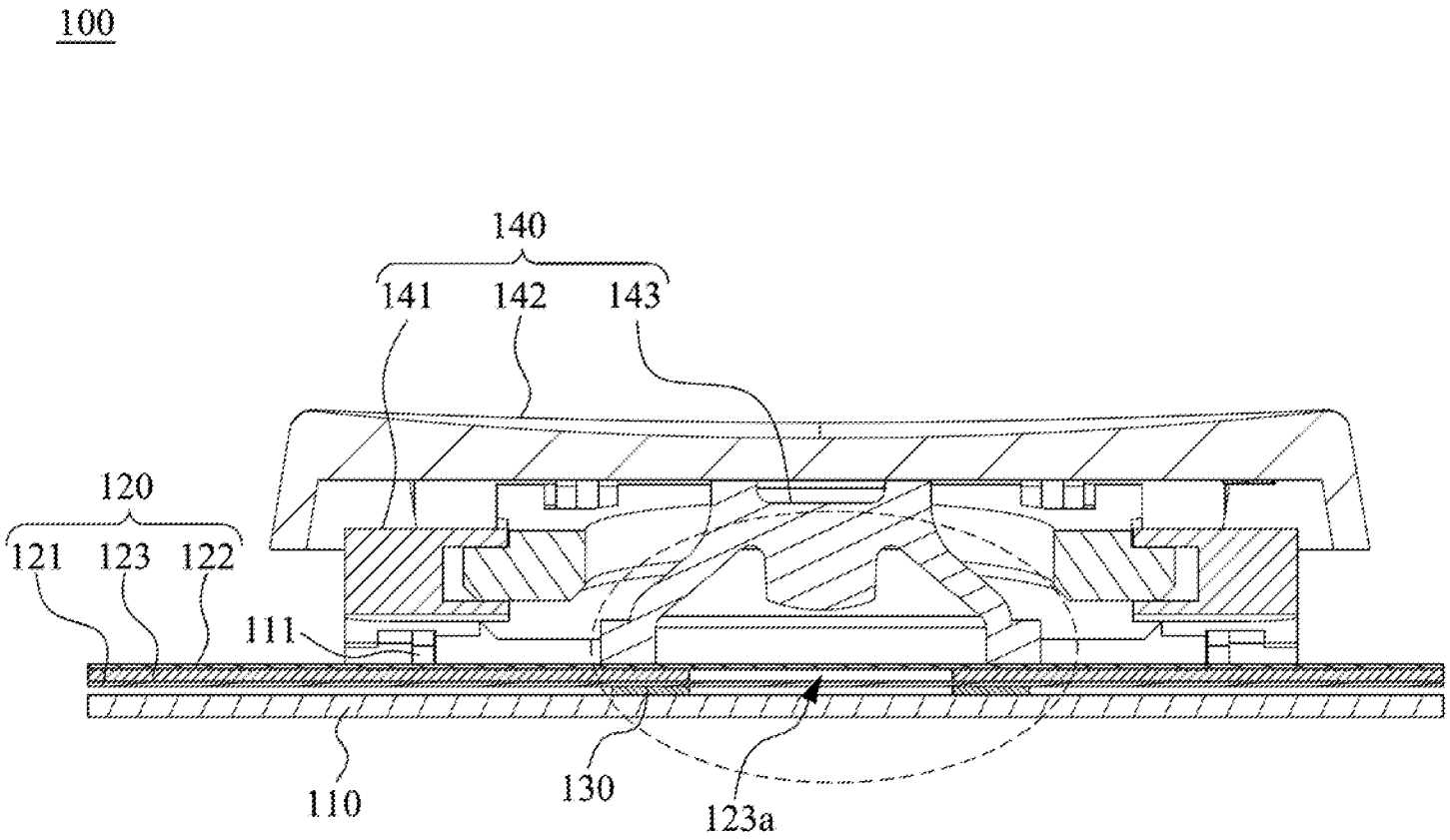
FIG. 3 is a cross-sectional view of the keyboard taken along line 3-3 in FIG. 1.

Reference is made to FIG. 2 and FIG. 3. FIG. 2 is a partial exploded view of the keyboard 100 in FIG. 1. FIG. 3 is a cross-sectional view of the keyboard 100 taken along line 3-3 in FIG. 1. As shown in FIGS. 1-3, in the embodiment, the keyboard 100 includes a bottom plate 110, a membrane circuit board 120, a plurality of spacer structures 130 (each of FIGS. 2 and 3 depicts one spacer structure 130 as a representative), and a plurality of keyswitch assemblies 140, in which the combination of the bottom plate 110, the membrane circuit board 120, a single spacer structures 130, and a single keyswitch assembly 140 can be regarded as an independent keyswitch device. The membrane circuit board 120 is disposed over the bottom plate 110. The keyswitch assembly 140 is disposed over the membrane circuit board 120. The spacer structures 130 are disposed between the bottom plate 110 and the membrane circuit board 120.

Specifically, the bottom plate 110 has hooks 111. The membrane circuit board 120 correspondingly has a perforation (not shown) for the hooks 111 of the bottom plate 110 to pass through. The keyswitch assembly 140 includes a connecting member 141, a keycap 142, and a restoring member 143. In the embodiment, the connecting member 141 is connected between the keycap 142 and the hooks 111 of the bottom plate 110 and formed by pivotally connecting two linkages, so as to make the keycap 142 move upwards and downwards relative to the bottom plate 110. The restoring member 143 is disposed over the membrane circuit board 120 and located between the keycap 142 and the membrane circuit board 120. When the keycap 142 is pressed downwards by an external force, the restoring member 143 generates a counterforce to the keycap 142 so as to provide users the feeling of pressing. When the external force applied onto the keycap 142 is released, the restoring member 143 can provide a restoring force for returning the keycap 142 back to its original position at which the keycap 142 is not pressed. In the embodiment, the restoring member 143 is a resilient member.

In a practical application, the connecting member 141 can be replaced by other supporting structure having similar function (i.e., making the keycap 142 move upwards and downwards relative to the bottom plate 110), such as a V-shaped linkage structure, an A-shaped linkage structure, or a linkage structure having two parallel linkages. The restoring member 143 can be replaced by other component having similar function, such as magnetic components.

As shown in FIGS. 2 and 3, in the embodiment, the membrane circuit board 120 includes a lower membrane layer 121, an upper membrane layer 122, and a spacer structure 123. The lower membrane layer 121 faces the bottom plate 110. The upper membrane layer 122 faces the keyswitch assembly 140. The spacer layer 123 is disposed between the lower membrane layer 121 and the upper membrane layer 122. That is, the lower membrane layer 121 and the upper membrane layer 122 are separated owing to the thickness of the spacer structure 123. The spacer structure 123 has a plurality of through holes 123*a* (each of FIGS. 2 and 3 depicts one through hole 123*a* as a representative) The through holes 123*a* are respectively located right under the keyswitch assemblies 140.

Figure 4:
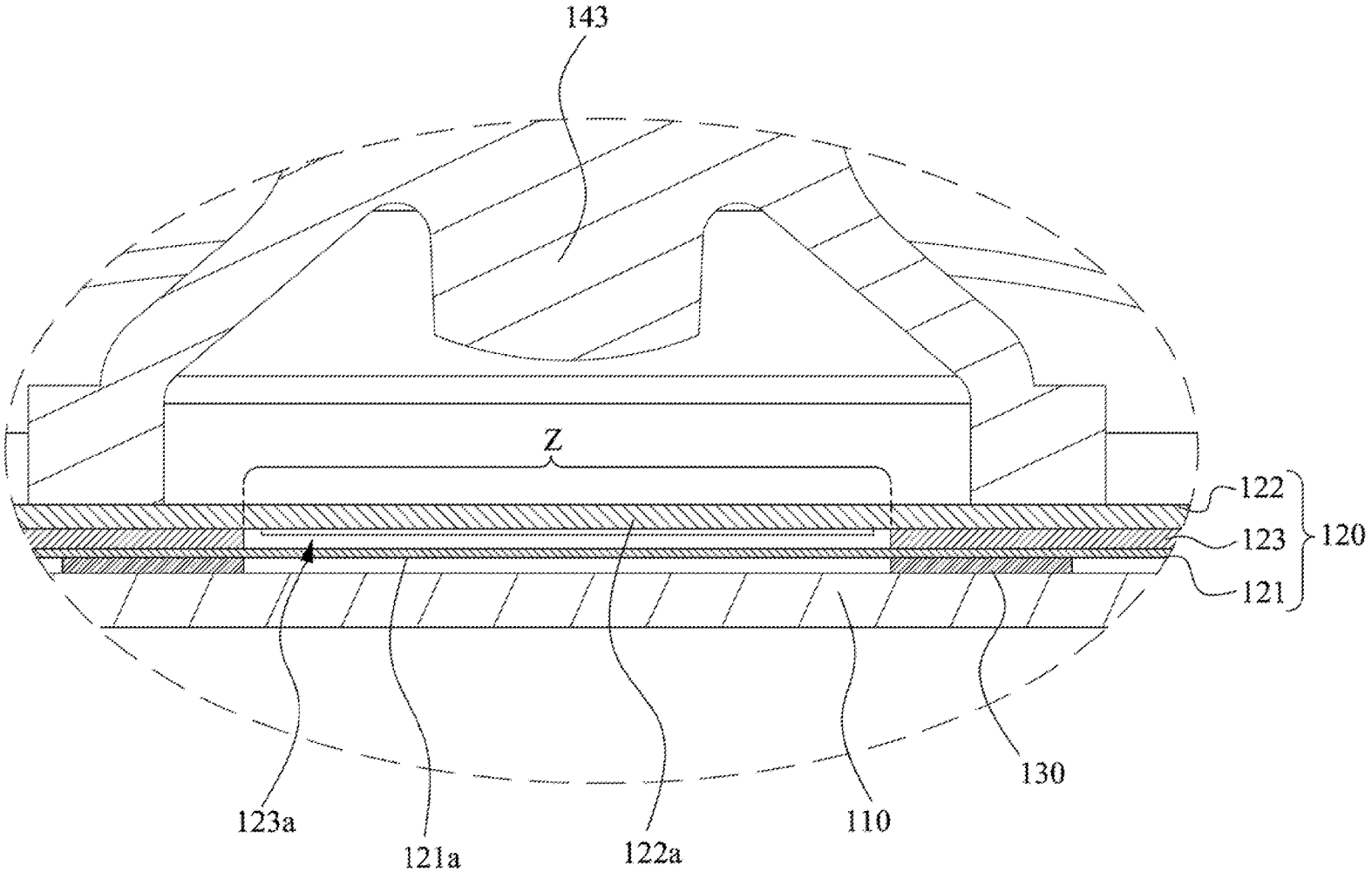
FIG. 4 is a partial cross-sectional view of a membrane circuit board according to an embodiment of the disclosure.

Reference is made to FIG. 4. FIG. 4 is a partial cross-sectional view of the membrane circuit board 120 according to an embodiment of the disclosure. As shown in FIG. 4, the lower membrane layer 121 has a plurality of trigger zones Z (FIG. 4 depicts one trigger zone Z as a representative). The membrane circuit board 120 is configured to generate a trigger signal when any of the trigger zones Z is pressed. Specifically, the lower membrane layer 121 includes a plurality of lower conductive points 121*a* (each of FIGS. 2-4 depicts one lower conductive point 121*a* as a representative) separated from each other. The upper membrane layer 122 includes a plurality of upper conductive points 122*a* (each of FIGS. 2-4 depicts one upper conductive point 122*a* as a representative) separated from each other. The upper conductive points 122*a* are configured to contact the lower conductive points 121*a* respectively via the through holes 123*a*. When the keycap 142 is not pressed, the upper conductive point 122*a* on the upper membrane layer 122 and the lower conductive points 121*a* on the lower membrane layer 121 are separated at opposite sides of the spacer structure 123 and electrically isolated. When the keycap 142 is pressed to move toward the bottom plate 110, the keycap 142 will directly or indirectly push the upper membrane layer 122 to partially enter the through hole 123*a* of the spacer structure 123, so as to make the upper conductive point 122*a* on the upper membrane layer 122 pass through the through hale 123*a* of the spacer structure 123 to contact the lower conductive points 121*a* on the lower membrane layer 121 (in the embodiment, the trigger behavior is performed by pushing the upper membrane layer 122 (by using the restoring member 143) to make the upper conductive point 122*a* trigger the lower conductive point 121*a*). Hence, the lower conductive point 121*a* immediately generates a trigger signal corresponding to the pressed keyswitch device. Therefore, the trigger zones Z are substantially defined by zones orthogonally projected from the through holes 123*a* to the lower membrane layer 121 and to the upper membrane layer 122. On the other hand, the trigger zones Z can be regarded as zones at which the upper membrane layer 122 deforms toward the lower membrane layer 121 via the through holes 123*a* when the membrane circuit board 120 is pressed. In some embodiments, the lower conductive points 121*a* is in form of finger electrodes. It should be pointed out that because the lower conductive points 121*a* is disposed on the lower membrane layer 121, the upper membrane layer 122 can be disposed with the upper conductive points 122*a* without having complicated circuit structures similar to the lower conductive points 121*a*.

As shown in FIGS. 2-4, in the embodiment, the spacer structures 130 are disposed between the bottom plate 110 and the membrane circuit board 120, and each of the spacer structures 130 is substantially aligned with a peripheral edge of the corresponding one of the trigger zones Z. Each of the spacer structures 130 is configured to separate the bottom plate 110 and the membrane circuit board 120 by a distance. Under the structural configuration, even if a foreign object enters the space formed between the membrane circuit board 120 and the bottom plate 110, the foreign object will not abut against and deform the lower membrane layer 121 toward the upper membrane layer 122. That is, the spacer structures 130 can prevent the lower conductive points 121*a* from electrically contacting the upper conductive points 122*a* on the upper membrane layer 122 due to the deformed lower membrane layer 121, so as to effectively prevent from the problem of false triggering.

In some embodiments, the spacer structures 130 are directly fixed to a surface of the membrane circuit board 120 facing the bottom plate 110, but the disclosure is not limited in this regard. In some other embodiments, the spacer structures 130 are directly fixed to a surface of the bottom plate 110 facing the membrane circuit board 120. Or, in some other embodiments, the spacer structures 130 are fixed to the bottom plate 110 and the membrane circuit board 120.

In some embodiments, each of the spacer structures 130 is a liquid cured layer. Preferably, each of the spacer structures 130 is a cured UV glue layer, an adhesive layer, or a printing ink layer, but the disclosure is not limited in this regard.

In some embodiments, a thickness of each of the spacer structures 130 is in a range from about 0.05 cm to 0.06 cm, so as to effectively prevent from the problem of false triggering without excessively increasing the whole thickness of the keyswitch device and that of the keyboard 100, but the disclosure is not limited in this regard.

In some embodiments, the lower conductive points 121*a* disposed on the lower membrane layer 121 can be manufactured by copper foil wires, or printed by a silver paste, but the disclosure is not limited in this regard.

As shown in FIG. 2, in the embodiment, the spacer structure 130 is ring-shaped and surrounds a peripheral edge of the trigger zone Z (see FIG. 4). Therefore, the spacer structure 130 can further prevent the membrane circuit board 120 from the influence of foreign object at the trigger zone Z.

Figure 5:
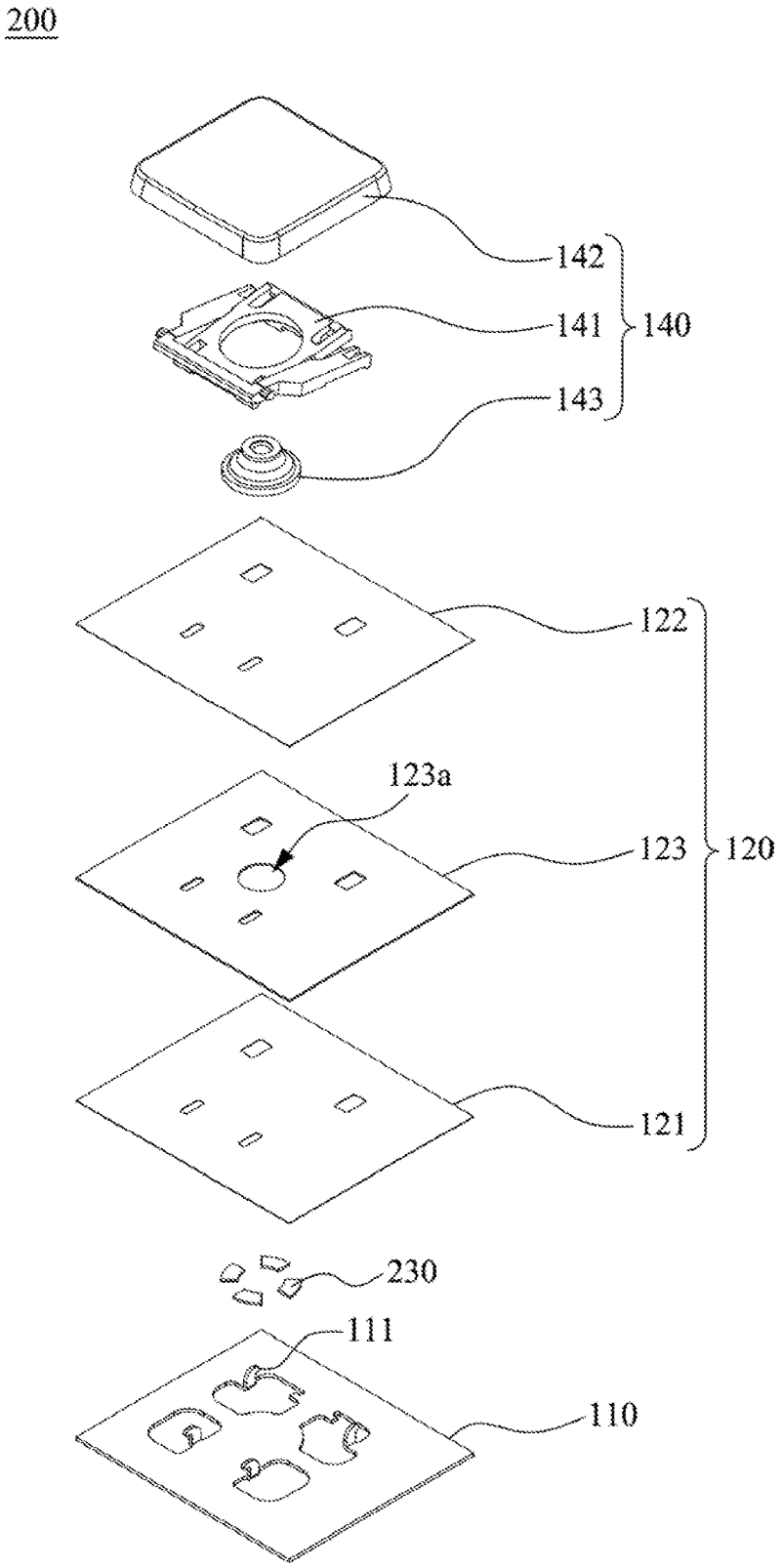
FIG. 5 is a partial exploded view of a keyboard according to another embodiment of the disclosure.

However, the shape of the spacer structure 130 is not limited by the embodiment in FIG. 2. Reference is made to FIG. 5. FIG. 5 is a partial exploded view of a keyboard 200 according to another embodiment of the disclosure. As shown in FIG. 5, in the embodiment, the keyboard 200 includes a bottom plate 110, a membrane circuit board 120, a plurality of spacer structures 230 (each of FIGS. 2 and 3 depicts one spacer structure 230 as a representative), and a plurality of keyswitch assemblies 140 (each of FIGS. 2 and 3 depicts one keyswitch assembly 140 as a representative), in which the combination of the bottom plate 110, the membrane circuit board 120, a single spacer structures 230, and a single keyswitch assembly 140 can be regarded as an independent keyswitch device. The bottom plate 110, the membrane circuit board 120, and the keyswitch assemblies 140 of the present embodiment are similar to those of the embodiment in FIG. 2, so the introductions of these components can refer to the previous descriptions and therefore are not repeated here to avoid duplicity. Compared with the embodiment of FIG. 2, each individual keyswitch device of the present embodiment includes a plurality of spacer structures 230 arranged to surround the peripheral edge of the trigger zone Z of the membrane circuit board 120. Therefore, a gap formed between any adjacent two of the spacer structures 230 serves as a passage communicating the space at the inner side of the spacer structures 230 (i.e., the space surrounded by the spacer structures 230) with the space at the outer side of the spacer structures 230.

According to the foregoing recitations of the embodiments of the disclosure, it can be seen that in the keyswitch device and the keyboard of the present disclosure, the spacer structure is disposed between the bottom plate and the membrane circuit board, so as to separate the bottom plate and the membrane circuit board by a distance. Therefore, even if a foreign object inadvertently enters the space formed between the membrane circuit board and the bottom plate, the foreign object will not abut against and deform the lower membrane layer toward the upper membrane layer, so as to effectively prevent from the problem of false triggering.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A keyswitch device, comprising:

a bottom plate;

a membrane circuit board located over the bottom plate and having a trigger zone, wherein the membrane circuit board is configured to generate a trigger signal when the trigger zone is pressed;

a keyswitch assembly disposed over the membrane circuit board and configured to press the trigger zone; and four spacer structures disposed between the bottom plate and the membrane circuit board and substantially aligned with a peripheral edge of the trigger zone, wherein the spacer structures are configured to separate the bottom plate and the membrane circuit board by a distance, wherein the spacer structure is a cured UV glue layer, and each spacer structure is arc-shaped, and wherein any adjacent two of the four spacer structures are separated by a gap.

2. The keyswitch device of claim 1, wherein the membrane circuit board comprises:

a lower membrane layer facing the bottom plate, wherein a lower conductive point is disposed on the lower membrane layer;

an upper membrane layer facing the keyswitch assembly, wherein an upper conductive point is disposed on the upper membrane layer; and a spacer layer disposed between the lower membrane layer and the upper membrane layer and having a through hole, wherein the upper conductive point is configured to contact the lower conductive point via the through hole, so as to make the lower conductive point generate the trigger signal correspondingly, and the trigger zone is substantially defined by a zone orthogonally projected from the through hole to the lower membrane layer and to the upper membrane layer.

3. The keyswitch device of claim 1, wherein the spacer structures are arranged to surround a peripheral edge of the trigger zone.

4. The keyswitch device of claim 1, wherein the spacer structures are directly fixed to a surface of the membrane circuit board facing the bottom plate.

5. The keyswitch device of claim 1, wherein the spacer structures are directly fixed to a surface of the bottom plate facing the membrane circuit board.

6. The keyswitch device of claim 1, wherein a thickness of each of the spacer structures is in a range from about 0.05 cm to 0.06 cm.

7. A keyboard, comprising:

a bottom plate;

a membrane circuit board located over the bottom plate and having a plurality of trigger zones, wherein the membrane circuit board is configured to generate a trigger signal when any of the trigger zones is pressed;

a plurality of keyswitch assemblies disposed over the membrane circuit board, each of the keyswitch assemblies being configured to press a corresponding one of the trigger zones; and a plurality of spacer structures disposed between the bottom plate and the membrane circuit board, every four of the spacer structures being substantially aligned with a peripheral edge of a corresponding one of the trigger zones and configured to separate the bottom plate and the membrane circuit board by a distance, and each spacer structure is arc-shaped, any adjacent two of the spacer structures are separated by a gap.

8. The keyboard of claim 7, wherein the membrane circuit board comprises:

a lower membrane layer facing the bottom plate, wherein a plurality of lower conductive points are disposed on the lower membrane layer;

an upper membrane layer facing the keyswitch assemblies, wherein a plurality of upper conductive points are disposed on the upper membrane layer and respectively corresponding to the lower conductive points; and a spacer layer disposed between the lower membrane layer and the upper membrane layer and having a plurality of through holes, wherein each of the upper conductive points is configured to contact a corresponding one of the lower conductive points via a corresponding one of the through holes, so as to make the corresponding lower conductive point generate the trigger signal correspondingly, and the trigger zones are substantially defined by zones orthogonally projected from the through holes to the lower membrane layer and to the upper membrane layer.

9. The keyboard of claim 7, wherein the spacer structures are directly fixed to a surface of the membrane circuit board facing the bottom plate.

10. The keyboard of claim 7, wherein the spacer structures are directly fixed to a surface of the bottom plate facing the membrane circuit board.

11. The keyboard of claim 7, wherein each of the spacer structures is a cured UV glue layer, an adhesive layer, or a printing ink layer.

12. The keyboard of claim 7, wherein a thickness of each of the spacer structures is in a range from about 0.05 cm to 0.06 cm.

* * * * *